United States Patent [19]

Bianchi et al.

[11] 4,133,320

[45] Jan. 9, 1979

[54] APPARATUS FOR DETERMINING THE INJECTED FUEL QUANTITY IN MIXTURE COMPRESSING INTERNAL COMBUSTION ENGINES

[75] Inventors: Valerio Bianchi, Hochdorf; Reinhard Latsch, Vaihingen, both of Germany

[73] Assignee: Robert Bosch GmbH, Stuttgart, Germany

[21] Appl. No.: 638,092

[22] Filed: Dec. 5, 1975

[30] Foreign Application Priority Data

Dec. 5, 1974 [DE] Fed. Rep. of Germany ..... 2457434

[51] Int. Cl.[2] ..... F02B 3/00

[52] U.S. Cl. ..... 123/32 EA; 123/32 EE

[58] Field of Search ..... 60/276, 285; 123/32 EA, 123/32 EE

[56] References Cited

U.S. PATENT DOCUMENTS

| | | | |
|---|---|---|---|
| 2,845,910 | 8/1958 | Pribble | 123/32 EA |
| 2,859,738 | 11/1958 | Campbell | 123/32 EA |
| 2,934,050 | 4/1960 | Pribble | 123/32 EA |
| 2,936,744 | 5/1960 | Paule | 123/32 EA |
| 2,982,276 | 5/1961 | Zechnall | 123/32 EA |
| 3,735,742 | 5/1973 | Aono | 123/32 EA |
| 3,745,768 | 7/1973 | Zechnall | 60/276 |
| 3,872,846 | 3/1975 | Taplin | 60/278 |

*Primary Examiner*—Douglas Hart
*Attorney, Agent, or Firm*—Edwin E. Greigg

[57] ABSTRACT

A fuel metering system of an internal combustion engine is controlled by an analog computer circuit which delivers injection pulses to actuate the fuel injection valves of the engine. The duration of these pulses is directly related to the amount of injected fuel and depends partly on the inherent electrical characteristics of the components of the analog computer circuit. The pulse duration also depends on the instantaneous values of at least two engine parameters, r.p.m. and throttle valve position, i.e., the degree of opening of the air inlet valve. The r.p.m. signal is sensed by an appropriate transducer and triggers a monostable multivibrator in the analog computer circuit while the throttle valve position is sensed by a potentiometer and defines the charging rate of a capacitor. The voltage on the capacitor influences the action of the monostable multivibrator which delivers the fuel injection pulse. A multiplier circuit may be connected between the analog circuit and the injection valves for admitting corrective control signals, e.g., from an exhaust gas sensor or from an engine smoothness sensor.

16 Claims, 6 Drawing Figures

APPARATUS FOR DETERMINING THE INJECTED FUEL QUANTITY IN MIXTURE COMPRESSING INTERNAL COMBUSTION ENGINES

BACKGROUND OF THE INVENTION

The invention relates to an apparatus for determining the injected fuel quantity in mixture compressing internal combustion engines by calculating the fuel required per stroke from the r.p.m. and the throttle valve position.

Mixture-compressing internal combustion engines must be supplied with the proper amount of fuel corresponding to the aspirated air quantity for each and every power stroke of the engine. The amount of fuel must be such that the combustion produces adequate power but operates without an excess of fuel which would result in an intolerably high degree of toxic components.

For these reasons, it is desired to supply a combustion fuel-air mixture which is either at the stoichiometric ratio, where the air number $\lambda = 1.0$ or lies in a region in which there is an excess of air; one thus obtains a relatively lean mixture which is particularly suitable to reduce toxic exhaust gas components so as to permit compliance with constantly more rigorous requirements with respect to atmospheric purity. In order to correctly determine the quantity of fuel delivered to the engine per power stroke, i.e., to correctly adjust the duration of fuel injection when electromagnetically actuated injection valves are used, it is necessary to know exactly the air quantity which is being aspirated by the engine. This knowledge may be derived from measurement of the air flow rate in the induction tube of the engine, for example by means of a baffle plate which is displaced against a restoring force and serves to adjust appropriate metering means coupled thereto. Unfortunately, this a relatively expensive process which, furthermore, suffers from the inherent disadvantage that the increase of the engine torque is delayed with respect to the opening of the throttle valve due to the inertia of the air flow measuring member.

Instead of making an air flow measurement, it is also possible to fix the fuel injection duration on the basis of the engine r.p.m. and the induction tube pressure. By following the characteristic curve of an induction tube pressure sensor, the correct amount of fuel as a function of induction tube pressure for a particular r.p.m. may be determined.

However, induction tube pressure measurements are also quite complicated and, just as in the baffle plate measurement, additional sensors are required and the above-mentioned delay in the increase of engine torque is also present. A supplementary mechanism is also required to achieve a temporary enrichment during a change of the throttle valve position so as to obtain a good transition from one state to the next.

It is also known to derive the required fuel quantity from two relatively easily accessible engine data, namely the engine r.p.m. and the throttle valve angle $\alpha$. When mechanical injection pumps are employed, the supplied fuel quantity is determined by a three-dimensional cam which adjusts for the proper fuel quantity as a function of a given r.p.m. and a given opening angle of the throttle valve.

It is also known to determine the fuel quantity to be injected electrically: by sensing the engine parameters r.p.m. and throttle valve angle, and this is a desirable method in principle because no additional sensors are required. The position of the throttle valve may be sensed relatively simply, for example with the aid of a suitable potentiometer and signals related to the engine r.p.m. may be derived from the ignition system or by simple sensing of an appropriate marker applied to the crankshaft with the aid of preferably an inductive transducer.

Unfortunately, the proper amount of fuel to be delivered to the internal combustion engine per power stroke is a relatively complicated function of the r.p.m. and the throttle valve position. Thus, each different type of engine has a particular and usually known set of characteristic curves which is exemplified by the diagram of FIG. 2 which will be discussed in more detail below. Due to the relatively complicated, nonlinear dependence, it has been considered to be impossible to generate the function corresponding to the proper fuel quantity to be injected by any reasonable means. In the function $t_i = f(\alpha, n)$, $t_i$ is the time during which the fuel is injected to a cylinder per power stroke and is therefore proportional to the fuel quantity Q. Since the above-mentioned function f is difficult to follow in a direct manner, a known circuit uses a low-pass filter in a pulse shaping circuit to transform it into a somewhat simpler function which is easier to follow, and this simpler function is subsequently multiplied by another r.p.m. dependent function. This known method also entails a substantial expense.

OBJECT AND SUMMARY OF THE INVENTION

It is, therefore, a principal object of the invention to provide an apparatus for determining the injected fuel quantity in mixture-compressing internal combustion engines from the prevailing throttle valve position and from the r.p.m. of the engine. In a preferred embodiment, this apparatus provides that the injected fuel quantity can be determined with high precision, maintains at least a stoichiometric fuel-air ratio or operates with an excess of air.

This object is achieved by the invention by providing an apparatus of the type described above and by providing, in addition, an analog computing circuit in which are stored data corresponding to a set of operational characteristics for a particular internal combustion engine. These data are so stored that when prevailing engine parameters, namely the throttle valve position $\alpha$ and the r.p.m. n are supplied to the computer, the charging time of a capacitor is directly related to the injection time of the fuel injection valves.

This analog computer circuit is capable of delivering a pulse whose length is proportional to the fuel injected and which is derived from a set of characteristic curves on the basis of prevailing throttle valve position and r.p.m. In a preferred embodiment of the invention, the computer circuit is coupled to a superimposed control loop or, again, the computer circuit is part of an overall control system in such a manner that engine data, suitably transduced, are fed back to the computer to modify in an appropriate manner the duration of the generated injection pulses. The feedback data may consist of signals from a device which senses the quiet running of the engine or from a system which senses the exhaust gas conditions and computes a datum corresponding to the original fuel-air mixture. These two feedback signals may also be used in combination. In this manner, the present invention particularly describes the computing circuit which computes the fuel injection time as a function of r.p.m. and of the throttle valve position. Thus, it is especially suited to be used in an apparatus for fuel mixture preparation such as described in the co-pending application Ser. No. 638,021 filed Dec. 5, 1975. That application particularly relates to the construction of an apparatus serving as a control system and it includes a computer circuit which delivers injection pulses to be used, for example by fuel injection valves wherein these pulses are derived on the basis of a specific set of characteristic curves and may be modified by engine data. This type of computing circuit is described in more detail below; the present invention thus relates to a specific electronic formation of a set of characteristic curves based on engine r.p.m. and throttle valve position.

The invention will be better understood as well as further objects and advantages thereof will become more apparent from the ensuing detailed specification of a preferred embodiment taken in conjunction with the drawing.

DESCRIPTION OF THE PREFERRED EMBODIMENT

Figure 1:
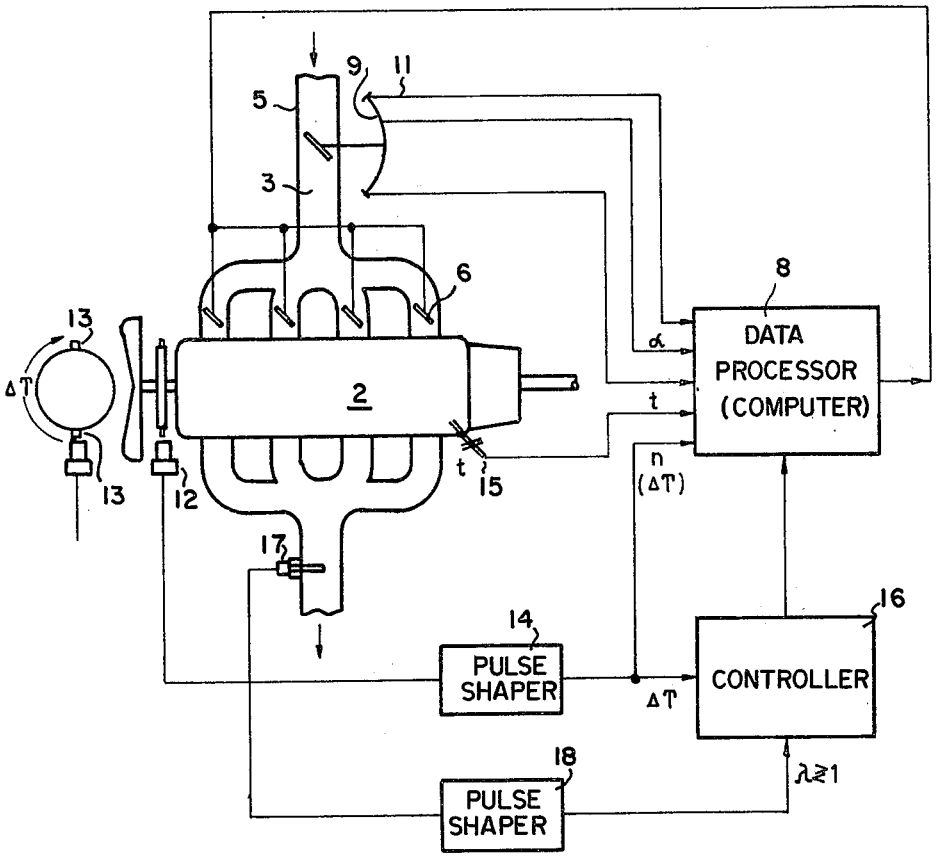
FIG. 1 is an overall schematic diagram of the engine and an associated overall control system including a computing circuit for determining the duration of fuel injection.

Turning now to FIG. 1, there is shown an engine 2 which is to be supplied with fuel metered out to each injection valve for a duration $t_i$. The engine is supplied with combustion air via a schematically indicated induction manifold 3 and expels the combusted exhaust gases through an exhaust line 4. Located within the induction tube is a throttle valve 5 which is actuated by a gas pedal linkage (not shown). In the region of the inlet valves, the induction manifold includes separate injection valves 6, one for each cylinder, which are controlled electrically by a common line 7 leading to a data processor or computer 8 to be described below. The injection valves receive fuel through separate supply lines, a pump and a filter from a pressurizing fuel circuit, all not shown, and this fuel is injected by the injection valves into the appropriate regions of the induction tube in the vicinity of the cylinders during a time period determined by the computer 8. Thus, the computer delivers an output signal whose duration is proportional to the duration of the injection commands delivered to the injection valves 6 and its inputs receive, firstly, a signal related to throttle valve position and, secondly, a signal proportional to r.p.m.

Figure 2:
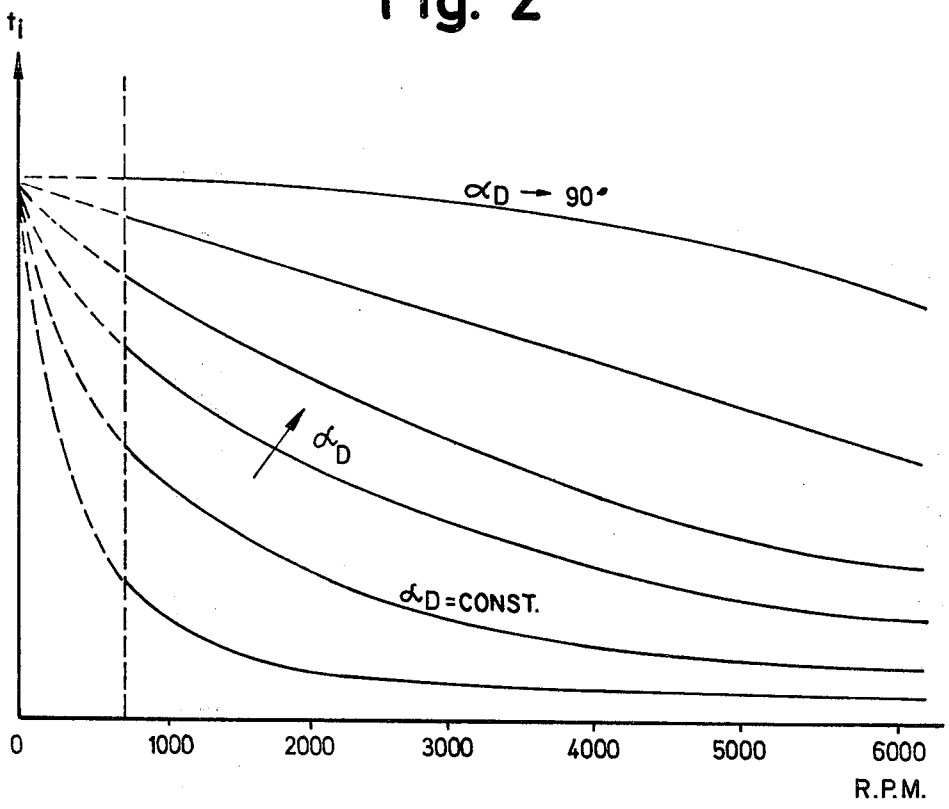
FIG. 2 is a set of characteristic curves specific to a particular internal combustion engine.

FIG. 2 shows the set of characteristic curves associated with an internal combustion engine which is stored in the computer 1, i.e., the computer knows this set of curves at all times and is thus capable to provide a signal related to the correct fuel quantity when it is fed the instantaneous valves of the r.p.m. and the throttle valve position.

The set of curves shown in FIG. 2 indicates the ordinate $t_i$ as the injection time per power stroke, i.e., the injected fuel quantity, as a function of the r.p.m. plotted along the abscissa. The different curves are associated with different, constant throttle valve positions. A set of characteristic curves such as shown in FIG. 2 is specific to a particular type of internal combustion engine and does not change during its operation, so that a set of curves of this type may be obtained once and for all by measurement for each engine or engine type. Once the curves have been determined, these data are stored in the computer.

Referring to FIG. 1, the computer or data processor 8 has instructions to deliver injection pulses of a particular duration through the injection valve 6 via the line 7 at any particular rpm and throttle valve position, all in accordance with the characteristic set of curves. The input data are obtained, according to FIG. 1, with the aid of a potentiometer 9 associated with the throttle valve 5 and this potentiometer circuit may also include a full load switch 10 and/or an idling switch 11 so that these particular operational states may generate special signals which are also fed to the computer 8. Furthermore, the computer is supplied with an rpm signal, obtained in known manner, for example from the ignition pulses or, as shown in the exemplary embodiment of FIG. 1, with the aid of a sensor 12 which, preferably inductively, senses the passage of markers 13 associated with the crankshaft. This signal is proportional to the engine rpm and may be fed to the computer 8, for example after passage through a pulse-shaping stage 14, as an rpm-related or a period-related signal. The sensor 12 is preferably also used to determine the degree of quiet running of the engine, i.e., the engine speed fluctuation.

Finally, the computer may receive a signal t, related to the cylinder head temperature or the cooling water temperature, which is obtained by a sensor 15 and serves to provide suitable conditions during cold starting and warm-up of the engine.

Based on these data, the computer 8 provides the injection pulse $t_i$ with the aid of the set of characteristic curves, such as those in FIG. 2. However, this selection is only a relatively coarse pre-control and, for this reason, there is provided a controller 16 which checks the operation of the computer 8 by measuring the actual engine behavior and which, by preferably multiplicative engagement of the computer, ensures a flawless and especially a clean operation of the engine with favorable fuel consumption.

For this purpose, the controller 16 may be supplied with a signal from a sensor 17 which monitors the exhaust gas conditions of the internal combustion engine. This signal is a normalized function of the sensor output and its numerical value can be greater than, equal to or smaller than the numerical value 1. This signal corresponds to the air number $\lambda$ which is related to the ratio of the combustion air to the fuel. The sensor 17 is so located in the exhaust pipe that it is able to determine whether the combustion mixture fed to the engine is stoichiometric or whether it contains excess air or fuel. Such sensors are known per se, so that a detailed description is unnecessary.

Figure 3:
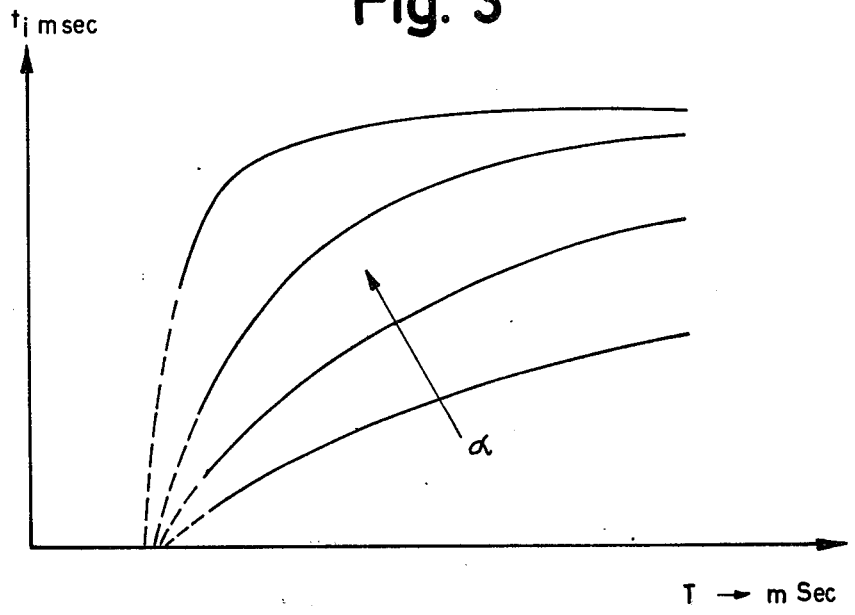
FIG. 3 shows the set of characteristic curves of FIG. 2 in a modified representation in which the abscissa carries the inverse r.p.m., i.e., the period or duration.

Before turning to the manner in which the electronic computer delivers the injection period signal on the basis of r.p.m. and throttle valve position, reference is made to FIG. 3 in which the injected fuel quantity is plotted as a function of the inverse r.p.m., i.e., the rotational period of the crankshaft. $T = 60/n$ when n is in r.p.m. Basically, the representation of FIG. 3 is similar to that of FIG. 2 and the set of curves, whose common parameter is the throttle valve position, has its theoretical origin at a finite, very small period. However, FIG. 3 also shows that each curve for a particular constant throttle valve angle is approximately exponential and that associated with each value of $\alpha$ is a particular constant in the exponent of e. Thus the set of curves shown in FIG. 3 could be represented approximately by the following equation:

$$t_i \approx t_{i\,max} \cdot (1 - e^{-T/\tau})$$

Figure 4:
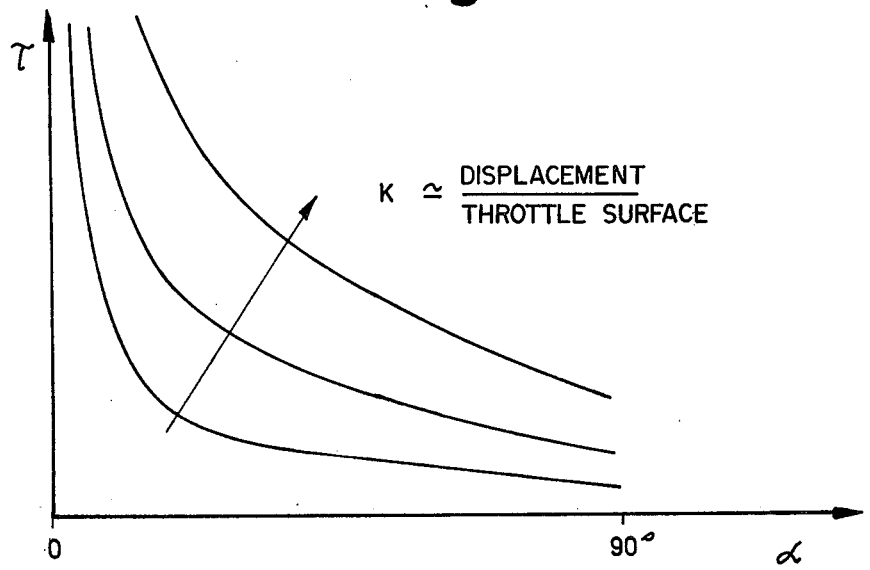
FIG. 4 shows the non-linear dependence of the time constant derivable from the set of curves in FIG. 3 as a function of the throttle valve angle.

Finally, the representation of FIG. 3 may be transformed into the set of curves shown in FIG. 4 by plotting the time constant of each exponential function in FIG. 3 for every opening angle $\alpha$ of the throttle valve between zero and 90°. From this family of curves it is immediately apparent that the time constant must be very large for small opening angles $\alpha$ of the throttle valve (slow rise of the exponential function) but that it is very small for large opening angles thereby giving rise to the generally hyperbolic shape of the curves in FIG. 4.

Generally, the relation $$\tau = k/f(\alpha) \qquad \text{holds}$$

in which k is approximately only a function of the engine displacement and the surface area of the throttle valve. FIG. 4 shows separate curves depicting t as the function of $\alpha$ for several internal combustion engines (k is the parameter which is peculiar to each engine).

The electronic computer circuit shown schematically in FIG. 5, due to the particular configuration of some of its circuit elements which will be explained in more detail below, is able to independently and dynamically formulate one of the required curves of FIG. 3 when it is supplied with the above-mentioned input data, namely the throttle valve position angle and a signal proportional to r.p.m. Thus it is able to deliver a datum which is related to the fuel quantity to be delivered to the engine. It is noted at this point, for clarity in comprehension of FIG. 5, that the physical quantity which provides a datum related to the injection period $t_i$ and hence to the fuel quantity to be injected after the control process is completed, is the voltage on the capacitor $C_1$.

Figure 5:
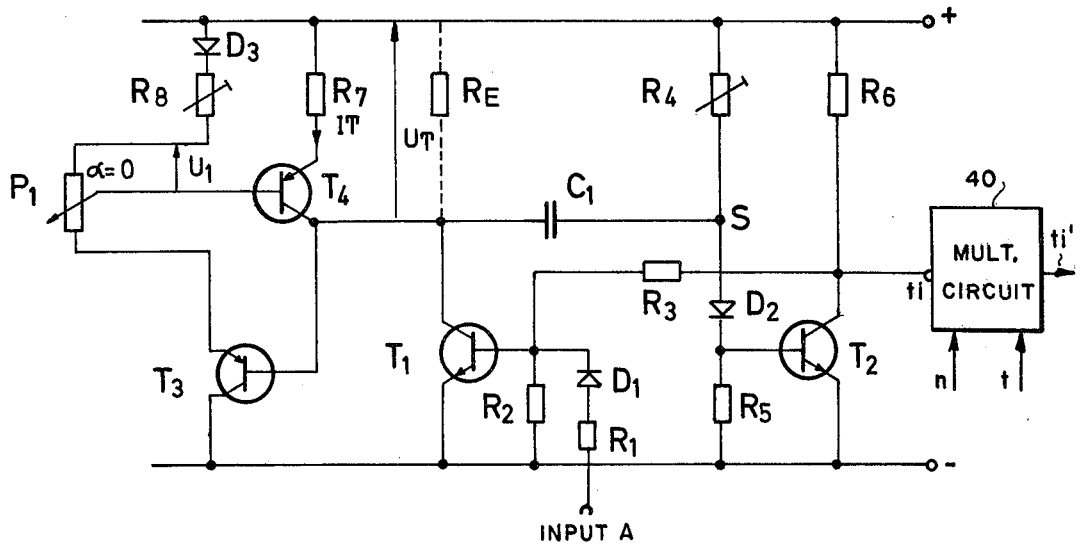
FIG. 5 is a schematic diagram of the computing circuit according to the invention.

As shown in FIG. 5, the circuit of the computer 8 contains two transistors $T_1$ and $T_2$ which are connected together to form a monostable multivibrator. Since the method of operation of such a monostable multivibrator is known per se, it is mentioned here only that the emitter of transistor $T_1$ is connected to ground while its base is connected to ground via a resistor $R_2$ as well as being connected through a resistor $R_3$ to the collector of the transistor $T_2$. The emitter of transistor $T_2$ is connected to ground, while its base is connected through a resistor $R_5$ to ground and also to the cathode of a diode $D_2$ whose anode is connected to the above-mentioned capacitor $C_1$ whose other electrode is coupled with the collector of transistor $T_1$. This provides a criss-cross circuit with the collector of the transistor $T_2$ being connected through a resistor $R_6$ to the positive potential as is the junction point S of the diode 2 and the capacitor $C_1$ through a possibly adjustable resistor $R_4$. The monostable multivibrator is triggered at an input A through a resistor $R_1$ connected to the anode of a diode $D_1$ whose cathode is coupled to the base of transistor $T_1$. The pulses whose length is proportional to the injection time $t_i$ are taken off from the collector of the transistor $T_2$. To simplify the discussion, the part of the circuit to the left of the monostable multivibrator will not be discussed now, but let it be assumed that the collector of transistor $T_1$ is temporarily connected through an imaginary resistor $R_E$ to the positive voltage source. This imaginary resistance $R_E$ must obey several conditions if the circuit shown is to be able to form a pulse duration $t_i$ from the period T and the throttle valve position $\alpha$ such as corresponds to the curve shown in FIG. 3. The time constant $\tau = R_E \cdot C_1$ of the capacitor $C_1$ and the resistor $R_E$ is equivalent to the time constant $\tau$ shown in FIG. 4. As the capacity of the capacitor $C_1$ is constant, the resistor $R_E$ must be capable of providing the reciprocal relationship regarding the throttle valve angle which is shown in FIG. 4.

In actual practice, the resistor $R_E$ is formed in this exemplary embodiment by a combination of two further transistors $T_3$ and $T_4$, the transistor $T_4$ having a feedback resistor $R_7$ coupled between its emitter and the positive voltage source, while its collector is connected to the collector of the transistor $T_1$. Also connected to this junction is the base of the transistor $T_3$ whose collector is grounded or connected to the prevailing negative potential and whose emitter is connected to one contact of a potentiometer $P_1$. The tap of the potentiometer is connected to the base of the transistor $T_4$ and its other contact is connected through a variable resistor $R_8$ and a diode $D_3$ to the positive voltage. The potentiometer $P_1$ is associated with the throttle valve, which means that, in the shown exemplary embodiment, the position of the throttle valve may be ascertained by the position of the potentiometer $P_1$. The throttle valve angle $\alpha$ could also be determined in another manner, for example by using a moving inductive coil or some other suitable transducers. It may be shown that this circuit results in a simulation of the resistor $R_E$ which causes it to be affected only by the position of the potentiometer but not by its particular resistance value. Furthermore, the particular hyperbola shown in FIG. 4 which corresponds to a predetermined ratio K equal to displacement/throttle valve surface, is also approximately generated. Let it be assumed at first that the resistance $R_8$ is not present and that, furthermore, the very small base-emitter potential of the transistor $T_4$ is compensated by the potential across the diode $D_3$ which is installed for this very purpose. Then the representation in FIG. 5 yields the following formula:

$$I_T = U_1/R_7$$

Since the transistor $T_3$ is connected as an emitter follower, the potential between its base and emitter is low and can be neglected in the present context. This means that the potential $U_1$ is directly proportional to the potential $U_T$ across the resistor $R_7$ plus the emitter-collector path of the transistor $T_4$, and that it depends entirely on the position of the potentiometer $P_1$. Thus the following relation holds $$U_1 = U_T \cdot \alpha$$

in which $\alpha$ is the relative position of the potentiometer $P_1$ correlated with the throttle valve position in which $\alpha$ may vary between the values $$0 \leqq \alpha \leqq 1.$$

The value 1 corresponds to a fully opened throttle valve. This yields the following formula for the current $I_T$ flowing through the resistor $R_7$ $$I_T = (U_T/R_7) \cdot \alpha$$

Since the above referred-to imaginary resistor $R_E$ could be represented as the ratio of the potential $U_T$ to the current $I_T$, this imaginary resistor, which is in actual fact represented by the circuit containing the two transistors $T_3$ and $T_4$, has the following value $$R_E = R_7/\alpha.$$

It may be seen from this formula that the imaginary resistor $R_E$ is a function which is proportional only to the position of potentiometer $P_1$ but not to its particular momentary value of resistance and this resistance need not be proportional to the position. Furthermore, this formula shows that the imaginary resistance $R_E$ is inversely proportional to the throttle valve angle $\alpha$ (assuming that the potentiometer function is substantially equivalent to the throttle valve position) so that the condition of FIG. 4, i.e., the hyperbolic curve shown there, is indeed simulated. Thus, the imaginary resistor $R_E$ formed in this manner acts like a resistor but it is inversely proportional to the throttle valve position angle so that, as a result, one obtains a voltage-controlled constant current source. The constant current source is voltage-controlled since, during a charging cycle of the capacitor $C_1$, the voltage at the collector of the transistor $T_1$ is changing and this change also appears at the potentiometer $P_1$ and hence at the base of the transistor $T_4$ whose current is thus controlled. Therefore, during the charging process of the capacitor $C_1$ and depending on the resistance value of the imaginary resistor $R_E$, charging curves result which have an exponential shape and correspond to those shown in FIG. 3. The charging constant $\tau$ has the following value $$\tau = (R_7/\alpha) \cdot C_1$$

FIG. 6*d* shows few possible curves which correspond to the charging of the capacitor $C_1$, with a single such curve being shown in full.

The method of operation of the circuit shown in FIG. 5 is thus as follows. When the input A receives a positive pulse in a chain of pulses whose frequency is inversely proportional to the engine period and thus proportional to the r.p.m. (amplitude and width being without significance, see FIG. 6*a*), the transistor $T_1$ becomes conducting and its collector voltage changes from a voltage related to the degree of charging of the capacitor $C_1$ to the value 0. At the same time, a negative voltage is propagated from the capacitor $C_1$ to the switching point S and its maximum value corresponds to the maximum value of the voltage previously prevailing at the collector of the transistor $T_1$ (diagram 6*b*). In other words, the capacitor $C_1$ differentiates the step function applied at one of its electrodes due to the triggering of the transistor $T_1$, and transmits at first the entire negative voltage pulse to the point S where it subsequently decays at a rate determined by the resistor $R_4$. Since the point S at first experiences a negative potential which is conducted to the base of the transistor $T_2$, the latter immediately blocks, thereby changing its collector potential to positive values (curve shown in FIG. 6*c*). All this occurs at or near the time $t_1$ in FIG. 6 and, depending on the magnitude of the negative potential propagated to this circuit point S (corresponding to the value $U_N$ in FIG. 6*b*), this condition continues until the negative potential at the point S has changed to a positive potential $U_p$ sufficient to cause the transistor $T_2$ to conduct again. This onset of conduction is designated $t_2$ and, at this moment, the collector potential of the transistor $T_2$ changes back to a value approximately equal to 0.

The negative potential transmitted to the circuit point S, which decays and causes the switchover of the transistor $T_2$, has a maximum amplitude which is equal to the maximum positive amplitude previously attained by the collector of the transistor $T_1$. This positive voltage depends in turn, firstly, on the time constant $\tau$ (and hence on the throttle valve position$\alpha$)and, secondly, on the time at which the charging cycle of the capacitor $C_1$ is interrupted by the arrival of the following trigger pulse at the input of the transistor $T_1$ and as shown in FIG. 6*a* which, in turn, is proportional to the rotational period T. Thus, the duration of the positive pulse occurring at the collector of the transistor $T_2$ is obviously also determined by these two magnitudes. Thus, it may be seen that the circuit shown in FIG. 5 can generate the set of curves of FIG. 3 electronically and dynamically at the required point of time in dependence on the throttle valve position and the rotational period T. Of course, the values of the resistor $R_7$ and of the capacitor $C_1$ can be changed at will for determining the entire set of characteristic curves at the outset.

Figure 6:
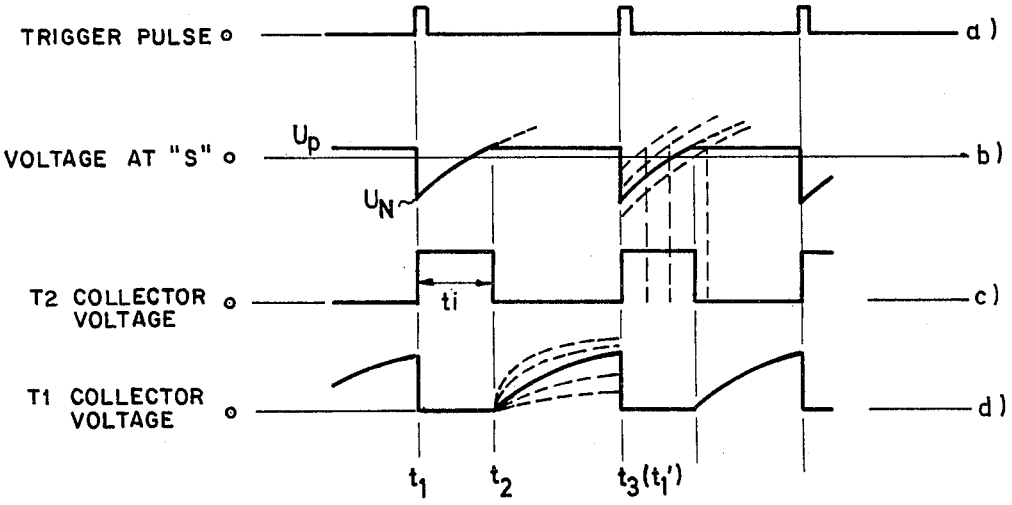
FIG. 6 is a set of diagrams showing the various potentials as a function of time at different points of the computing circuit in FIG. 5.

FIG. 6 shows some of the possible values of circuit potentials in dotted lines, in each case with one such possible curve being fully drawn out.

It has been explained that the duration of the charging of the capacitor $C_1$ is determined by the rotational period T so that, at the end of a single rotation, the capacitor $C_1$ is charged to a potential which is proportional to the fuel injection time $t_i$. The transformation of this voltage into a time period is performed, in principle, by having the trigger pulse shown in FIG. 6*a* make the transistor $T_1$ conducting and by discharging the capacitor $C_1$ through the resistor $R_4$. Strictly speaking, the discharging process would have to take place at constant current, i.e., the changes of the negative potential at the point S (curve 6*b*) should be linear in the direction of positive values. However, since at most half the height of the exponential function is actually used, the initial linearity is sufficient.

If the resistor $R_8$ shown in FIG. 5, which is variable, were not present in the circuit, then the position $\alpha = 0$ of the potentiometer $P_1$, which corresponds to a closed throttle valve, would designate an operational point with no combustion air at all, i.e., $t_i = 0$. But the engine requires a certain amount of idling air which is admitted through an idling channel and thus also requires a certain amount of idling fuel which is determined by the adjustable value of the resistor $R_8$. However, if for any reason this resistor $R_8$ is to be eliminated, (so as to make the control entirely dependent on the position of the potentiometer tap), then a relatively high-valued resistor could be inserted instead of $R_E$ for serving as an idling control and to introduce other corrections.

The upper limit of the set of curves in FIG. 3 may be adjusted with the aid of the resistor $R_4$. Furthermore, the curves of FIG. 3 show that the curves do not originate at the center of coordinates $t_i = 0$, $T = 0$, but rather at finite values of T, i.e., as shown by an extrapolation of the curves in dotted lines to the value $t_i = 0$, the engine no longer requires any fuel at a finite, albeit quite high, r.p.m.

This phenomenon is automatically compensated by the circuit of FIG. 5. As may be seen from FIG. 6*d*, for example, the voltage increase at the collector of the transistor $T_1$ or the charging cycle of the capacitor $C_1$ does not require the entire period T, but only the difference between T and $t_i$. In other words, the charging process of the capacitor begins only at the point $t_2$ and is terminated at the point $t_3$ by the triggering pulse of the rotational sensor.

The circuit also makes the values of $t_i$, which correspond to a throttle valve change, somewhat larger (acceleration) and somewhat smaller (deceleration) at the outset than strictly corresponds to the particular throttle valve setting $\alpha$ . This may be regarded as a transitional enrichment or leaning-out.

Finally, the desired pulse of width $t_i$, which is taken from the collector of the transistor $T_2$, is fed to a multiplier circuit 40 which produces the actual setting signal. This multiplying circuit, which may be provided with the above referred-to control signals and to which correctional signals and other data may be supplied, is the circuit which performs the superimposed control function. The circuit of FIG. 5 according to this invention primarily represents the computer or data processor circuit 8 which, as already mentioned, electronically generates the set of characteristic curves relating r.p.m. and throttle valve angle with fuel quantity and thus provides a precontrol of the particular required fuel quantity. This correlation can be relatively coarse because the superimposed control process which is described in great detail in the co-pending application Ser. No. 638,021 filed on Dec. 5, 1975, is able to provide a much more sensitive control of the engine operation. A possible control process to be used by the superimposed control system might depend on regulating a particular value of the air number, i.e., $\lambda = 1$ or leaner, a control process based on quiet (smooth) running or a control process based on maximum r.p.m. and minimum fuel consumption.

However, the forward control process according to the present invention may be used alone, and, in that case, it might be suitable to apply an r.p.m.-correction, especially in the region of full load. Such a correction may be made by an appropriate dimensioning of the resistor $R_4$, which can also be embodied as a variable resistor. Such a correction is not necessary in an overall control process because such a process could include r.p.m. correction.

What is claimed is:

1. In an apparatus for determining the correct fuel quantity to be injected by injection valves into an internal combustion engine, said apparatus including at least a first transducer for generating pulses dependent on engine r.p.m. and a second transducer for engine throttle valve position, an electonic circuit including first and second semiconductor switching elements connected to form a monostable multivibrator the feedback branch of which includes a timing capacitor and means connecting said first transducer to one of said switching elements, the improvement comprising:

said electronic circuit further contains a charging current source being connected to said timing capacitor and said charging current source includes means for altering the magnitude of said charging current in dependence on the position of the engine's throttle and further includes electronic means for altering the charging current in dependence on the potential at said capacitor, and means terminating the charging process of said timing capacitor by switchover of said monostable multivibrator triggered by the arrival of rpm-dependent pulses, and whereby the charge on said capacitor contains rpm-dependent valve opening information which can be used without interposition of rpm-dependent distributor means.

2. An apparatus as defined in claim 1, wherein the charging time constant of said capacitor is inversely proportional to the position of the throttle valve of the engine.

3. An apparatus as defined in claim 1, wherein said first and second semi-conductor switching elements are first and second transistors whose emitters are coupled directly to ground, the base of each transistor is coupled to ground through a resistor and the collector of said second transistor is coupled to the base of said first transistor through a resistor; whereby the fuel injection signal duration, which is proportional the fuel quantity, may be obtained at the collector of said second transistor.

4. An apparatus as defined in claim 1, wherein said capacitor is connected between the collector of said first transistor and the base of said second transistor and wherein the base of said second transistor is connected to positive potential through a resistor and the collector of said second transistor is also connected to positive potential through a resistor.

5. An apparatus as defined in claim 1, further comprising a fourth transistor whose collector is connected to said capacitor and whose emitter is connected to the positive potential through a resistor, thereby determining the charging time constant of said capacitor.

6. An apparatus as defined in claim 5, wherein the collector of said fourth transistor is connected to the collector of said first transistor and the base of said fourth transistor is provided with a signal which is proportional to the position of the throttle valve.

7. An apparatus as defined in claim 6, further comprising a potentiometer whose tap is connected to the base of said fourth transistor and one of the leads of said potentiometer is connected to positive potential and the other of the leads of said potentiometer is connected via a load decoupling element to the junction of the collectors of said first and fourth transistors.

8. An apparatus as defined in claim 7, wherein said element is a third transistor and wherein said other lead of said potentiometer is connected to the emitter of said third transistor, the collector of said third transistor is connected to a nonpositive potential and the base of said third transistor is connected to the junction of the collectors of said first and fourth transistors and of one lead of said capacitor.

9. An apparatus as defined in claim 7, wherein said one of the leads of said potentiometer is connected to positive potential through a diode; thereby providing compensation for the base-emitter potential of said fourth transistor.

10. An apparatus as defined in claim 9, further comprising a variable resistor, connected between said one of the leads of said potentiometer and said compensating diode, for providing engine idle adjustment.

11. An apparatus as defined in claim 1, further comprising first and second transistors, connected as a monostable multivibrator, and a diode and a resistor connected in series with the base of said first transistor; whereby said first transistor may be provided with r.p.m.-proportional pulses through said series-connected diode and resistor.

12. An apparatus as defined in claim 11, further comprising a multiplier circuit connected to the collector of said second transistor, said multiplier circuit being provided with corrective control signals related to engine parameters.

13. An apparatus as defined in claim 12, wherein said corrective control signals are derived from the smoothness of the engine operation.

14. An apparatus as defined in claim 12, further comprising a sensor, located in the exhaust system, for providing signals related to the air number, said signals being fed to said multiplier circuit as corrective control signals.

15. An apparatus as defined in claim 12, wherein said corrective control signals are derived from the smoothness of engine operation and from the conditions of the exhaust gas in such manner that smoothness control takes place only when the air number is equal to unity and less than unity.

16. An apparatus as defined in claim 12, wherein said corrective control signals are derived from a control process based on maximum r.p.m. and minimum fuel consumption.

* * * * *